US007426754B2

(12) United States Patent
Chun et al.

(10) Patent No.: US 7,426,754 B2
(45) Date of Patent: Sep. 23, 2008

(54) FUNCTIONAL CLOTHING ARTICLE

(76) Inventors: Nancy Dukyong Chun, 12841 Oakwood La., La Mirada, CA (US) 90638; Stephano Youngil Chun, 12841 Oakwood La., La Mirada, CA (US) 90638

( * ) Notice: Subject to any disclaimer, the term of this patent is extended or adjusted under 35 U.S.C. 154(b) by 16 days.

(21) Appl. No.: 11/074,681

(22) Filed: Mar. 9, 2005

(65) Prior Publication Data

US 2005/0229295 A1 Oct. 20, 2005

(30) Foreign Application Priority Data

Mar. 19, 2004 (KR) ..... 10-2004-0019036

(51) Int. Cl.
*A41D 13/00* (2006.01)

(52) U.S. Cl. ..... 2/46

(58) Field of Classification Search ..... 2/44, 2/46, 48, 50–51, 92, 102, 69, 310–317, 338; 128/99.1, 100.1, 101.1, 102.1
See application file for complete search history.

(56) References Cited

U.S. PATENT DOCUMENTS

| | | | | |
|---|---|---|---|---|
| 1,599,688 | A | 9/1926 | Sullivan | |
| 2,249,198 | A | 7/1941 | Carter | |
| 2,481,396 | A | 9/1949 | Cohen | |
| 2,553,353 | A | 5/1951 | Binder | |
| 2,641,258 | A | 6/1953 | Rutledge | |
| 2,910,984 | A | 11/1959 | Yeakey et al. | |
| 3,029,814 | A | 4/1962 | Kravitz | |
| 3,116,735 | A * | 1/1964 | Geimer | 450/2 |
| 3,141,457 | A | 7/1964 | Davidson | |
| 3,434,469 | A | 3/1969 | Swift | |
| 3,441,027 | A | 4/1969 | Lehman | |
| 3,454,003 | A | 7/1969 | Sailhen Dit Kelber-Sailhen | |
| 3,526,229 | A | 9/1970 | Blair | |
| 3,554,190 | A | 1/1971 | Kaplan | |
| 3,756,247 | A | 9/1973 | Hand | |
| 4,175,553 | A | 11/1979 | Rosenberg | |
| 4,400,832 | A | 8/1983 | Kinder | |
| 4,475,543 | A | 10/1984 | Brooks et al. | |
| 4,572,167 | A | 2/1986 | Brunswick | |
| 4,833,730 | A | 5/1989 | Nelson | |
| 4,836,194 | A | 6/1989 | Sebastian et al. | |
| 4,907,576 | A | 3/1990 | Curlee | |
| 4,926,845 | A | 5/1990 | Harris | |
| 4,941,237 | A | 7/1990 | Hovis | |
| 5,040,524 | A | 8/1991 | Votel et al. | |

(Continued)

FOREIGN PATENT DOCUMENTS

| | | |
|---|---|---|
| EP | 0 410 904 A1 | 1/1991 |

(Continued)

*Primary Examiner*—Tejash Patel
(74) *Attorney, Agent, or Firm*—Harness, Dickey & Pierce, P.L.C.

(57) ABSTRACT

The functional clothing article includes a body for receiving and supporting a femoral region, a hip region, an abdominal region and a waist region of a user. An abdominal support unit is provided at a front portion of the body to support the abdominal region. A hip support unit is provided at a rear portion of the body to elastically support the hip region. The hip supporting unit includes a fastening unit for detachably coupling the hip support unit to the abdominal support unit.

11 Claims, 9 Drawing Sheets

U.S. PATENT DOCUMENTS 5,086,759 A 2/1992 Buddingh
5,147,261 A 9/1992 Smith et al.
5,148,549 A * 9/1992 Sydor ..... 2/44
5,188,585 A 2/1993 Peters
5,205,815 A 4/1993 Saunders
5,334,134 A * 8/1994 Saunders ..... 602/19
5,399,150 A 3/1995 Saunders
5,465,428 A * 11/1995 Earl ..... 2/238

FOREIGN PATENT DOCUMENTS

GB 2 243 787 A 11/1991

* cited by examiner

FUNCTIONAL CLOTHING ARTICLE

BACKGROUND OF THE INVENTION

1. Field of the Invention

The present invention relates to functional clothes.

2. Description of the Prior Art

Conventional clothes have been used for sprucing people up while protecting people from external impact. Recently, various functional clothes having an abdominal band function have been developed in the form of underwear, medicalwear and sportswear in order to support and protect a waist region or an abdominal region of a user.

For instance, Korean Utility Model No. 20-0258906 registered in Korean Intellectual Property Office on Dec. 14, 2001 discloses "Male Girdle Having Abdominal Band", which is shown in FIG. 7.

As shown in FIG. 7, a conventional male girdle 10 mainly includes an abdominal band 20 for supporting and protecting a waist, a back, and a lower abdominal region of a user, a cavity section 30 for receiving the genitals of the user, and a leg section 40 suitable for receiving legs of the user.

A first connection part 22 having a predetermined elastic property adaptable for pressing the waist of the user is formed at one end of the abdominal band 20. In addition, a second connection part 24 is provided at the free end of the first connection part 22. The second connection part 24 is connected to the first connection part 22 in order to press the lower abdominal region of the user. One surface of the second connection part 22 is formed with an adhesive fiber and the other surface of the second connection part 22 is formed with an elastic fiber.

A fourth connection part 26 having a predetermined elastic property adaptable for pressing the waist of the user is formed at the other end of the abdominal band 20. In addition, a fifth connection part 28 is provided at the free end of the fourth connection part 26. The fifth connection part 28 is connected to the fourth connection part 26 in order to press the lower abdominal region of the user. One surface of the fifth connection part 28 is formed with a Velcro tape and the other surface of the fifth connection part 28 is formed with an elastic fiber.

In the conventional male girdle having the abdominal band, the second connection part 24 is coupled with the fifth connection part 28. At this time, since the second connection part 24 is overlapped with the fifth connection part 28, the abdominal region of the user is tightly pressed.

In addition, the conventional male girdle has no devices for supporting the waist or the hip of the user, so the usage of the conventional male girdle is very limited.

SUMMARY OF THE INVENTION

One embodiment of the present invention provides a functional clothing article including a body for receiving and supporting a femoral region, a hip region, an abdominal region and a waist region of a user. An abdominal support unit is provided at a front portion of the body to support the abdominal region. A hip support unit is provided at a rear portion of the body to elastically support the hip region. The hip support unit includes a fastening unit for detachably coupling an extension part of the hip support unit to the abdominal support unit.

According to the one embodiment of the present invention, the abdominal support unit is made from a material having less flexibility than the hip support unit.

In one embodiment, the abdominal support unit is rounded in order to support a lower portion of the abdominal region.

In cases of functional male clothes, the abdominal support unit may support an upper portion of the abdominal region and may be formed at a lower portion thereof with a cavity section for receiving the genitals of the user.

The hip support unit may have a butterfly shape and a part of the hip support unit may be coupled to the body along a lower portion of the hip region.

The hip support unit may have a waist support section, which is positioned corresponding to the waist region of the user, for elastically supporting the waist region in a longitudinal direction of the waist region.

An upper portion and extension parts of the hip support unit may be made from elastic materials in order to allow the user to adjust pressing force with respect to the abdominal region. A plurality of rubber bands may be transversely provided from an inner portion of the hip support plate to an inner portion of the extension part, and the extension part serving as the fastening unit is attachable to a portion of the abdominal support unit.

The fastening unit may be coupled to a part of the abdominal support unit so as to prevent the abdominal region from being tightly pressed.

The body, the abdominal support unit and the hip support unit may be made from elastic fibers having a superior sweat absorption property.

BRIEF DESCRIPTION OF THE DRAWINGS

The features and advantages of the present invention will be more apparent from the following detailed description taken in conjunction with the accompanying drawings, in which.

DETAILED DESCRIPTION OF THE EXAMPLE EMBODIMENTS

Hereinafter, functional clothes according to example embodiments of the present invention will be described with reference to the accompanying drawings.

Figure 1:
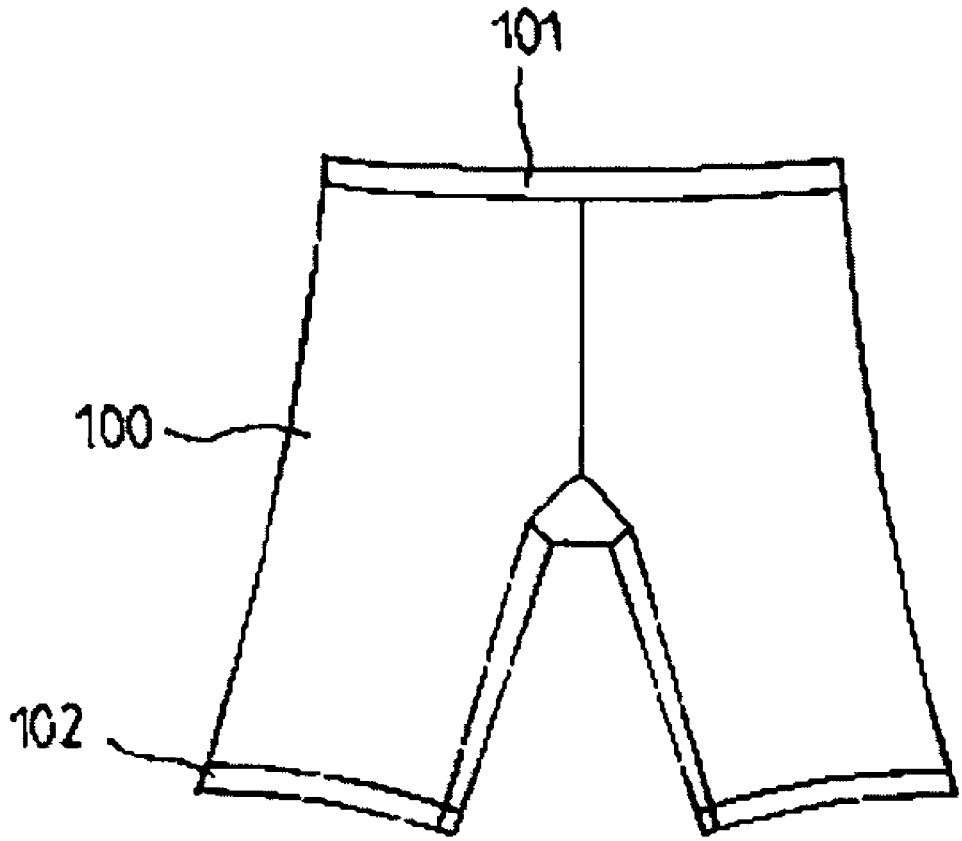
FIG. 1 is a front view illustrating a body of functional clothes according to one embodiment of the present invention.
Figure 2:
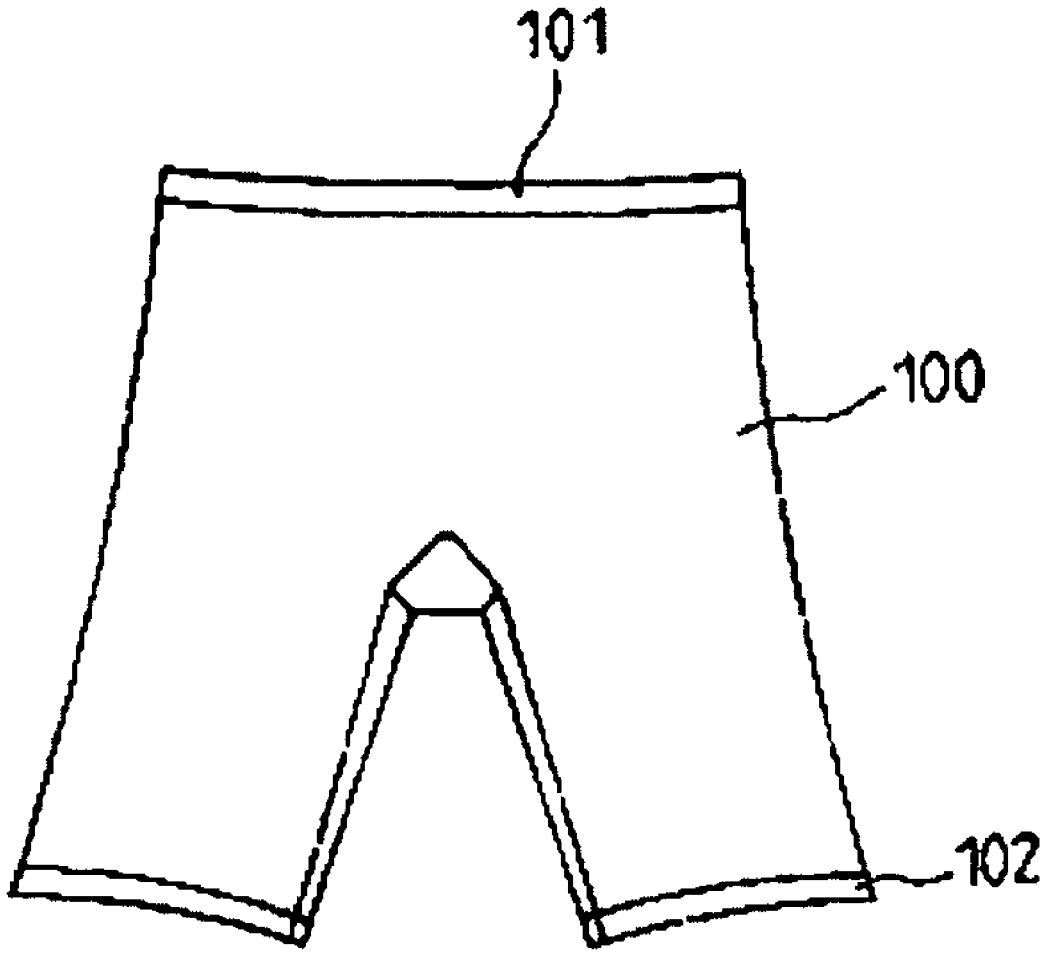
FIG. 2 is a rear view of functional clothes shown in FIG. 1.

A body 100 of the functional clothes according to an example embodiment of the present invention is shown in FIGS. 1 and 2.

As shown in FIGS. 1 and 2, the functional clothes have a body 100 in the form of breeches. The body 100 may be made from various materials such as CoolMax and Moistex. If the functional clothes are used as sportswear, the body 100 may be made from an elastic fiber having a superior sweat absorption property.

A waist section 101 is sewed on an upper portion of the body 100 so as to closely support a waist of a user.

In addition, thigh support sections 102 are sewed on a lower portion of the body 100 so as to closely support thighs of a user.

Figure 3A:
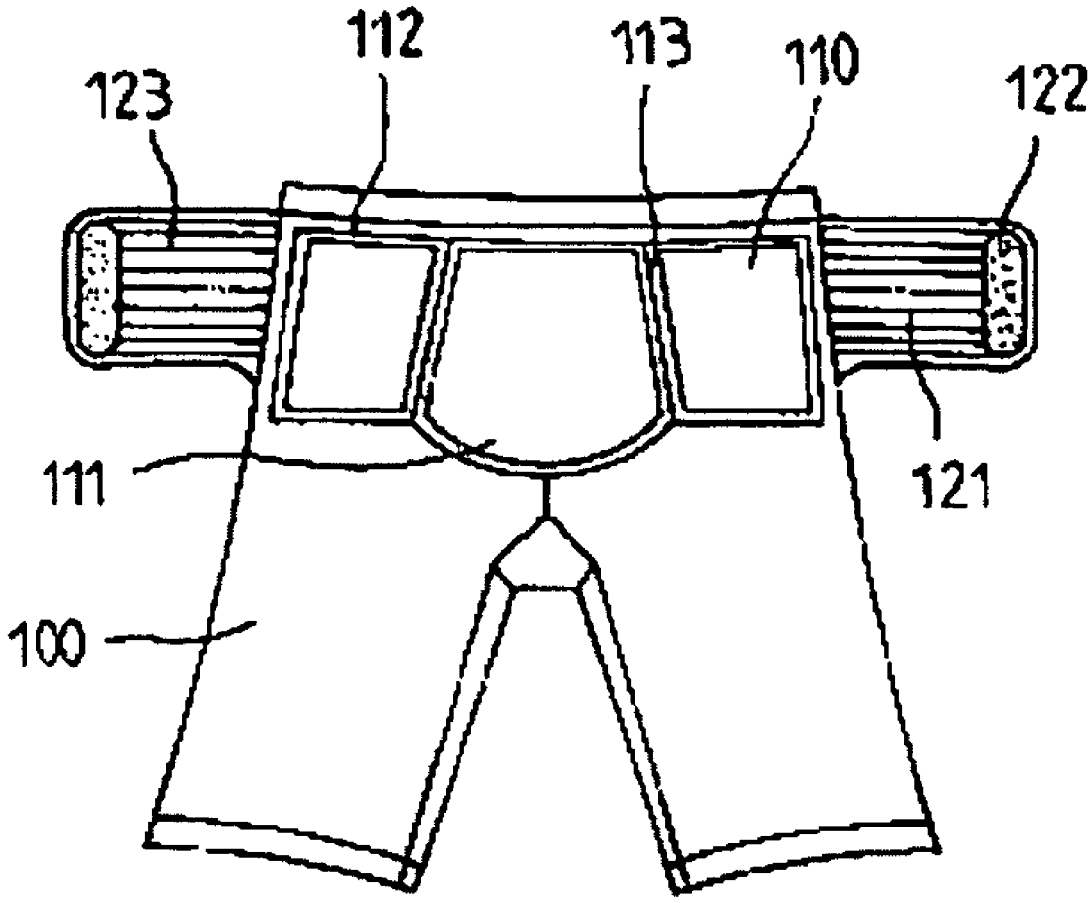
FIG. 3A is a schematic front view illustrating a body of functional clothes as shown in FIG. 1, in which an abdominal support plate is coupled to a front portion of the body.
Figure 3B:
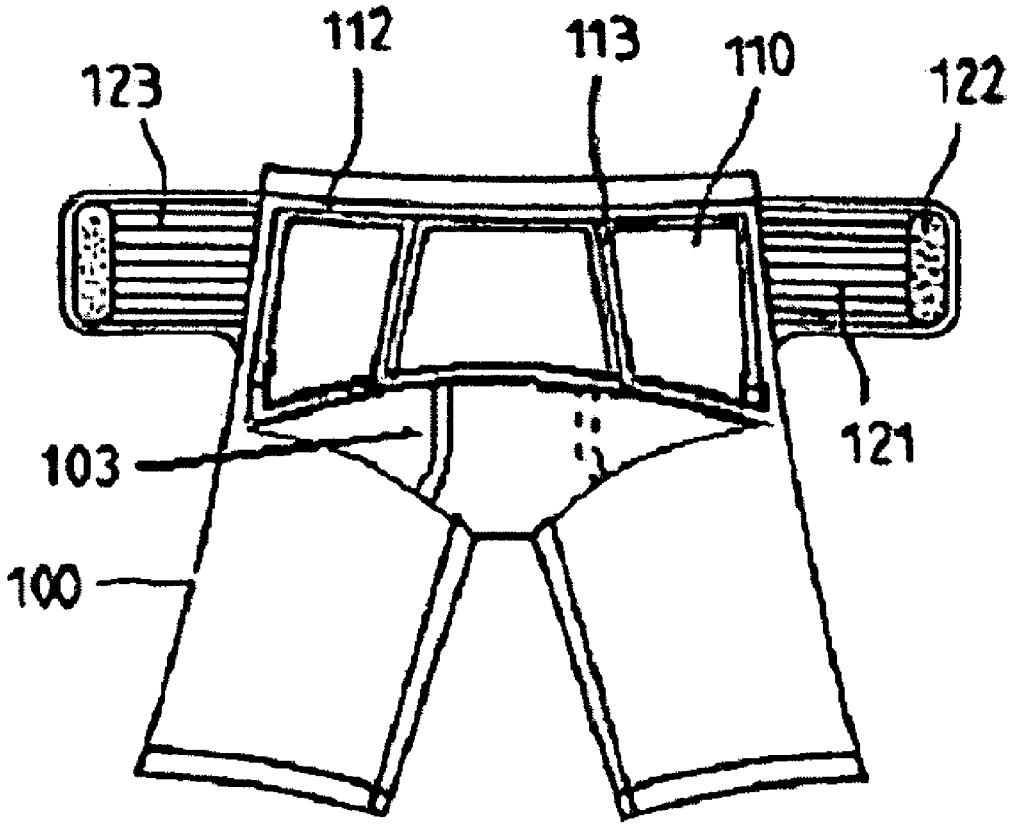
FIG. 3B is a schematic front view illustrating a body of functional clothes as shown in FIG. 1, in which an abdominal support plate and a cavity section for receiving the genitals of the user are coupled to a front portion of the body.
Figure 4:
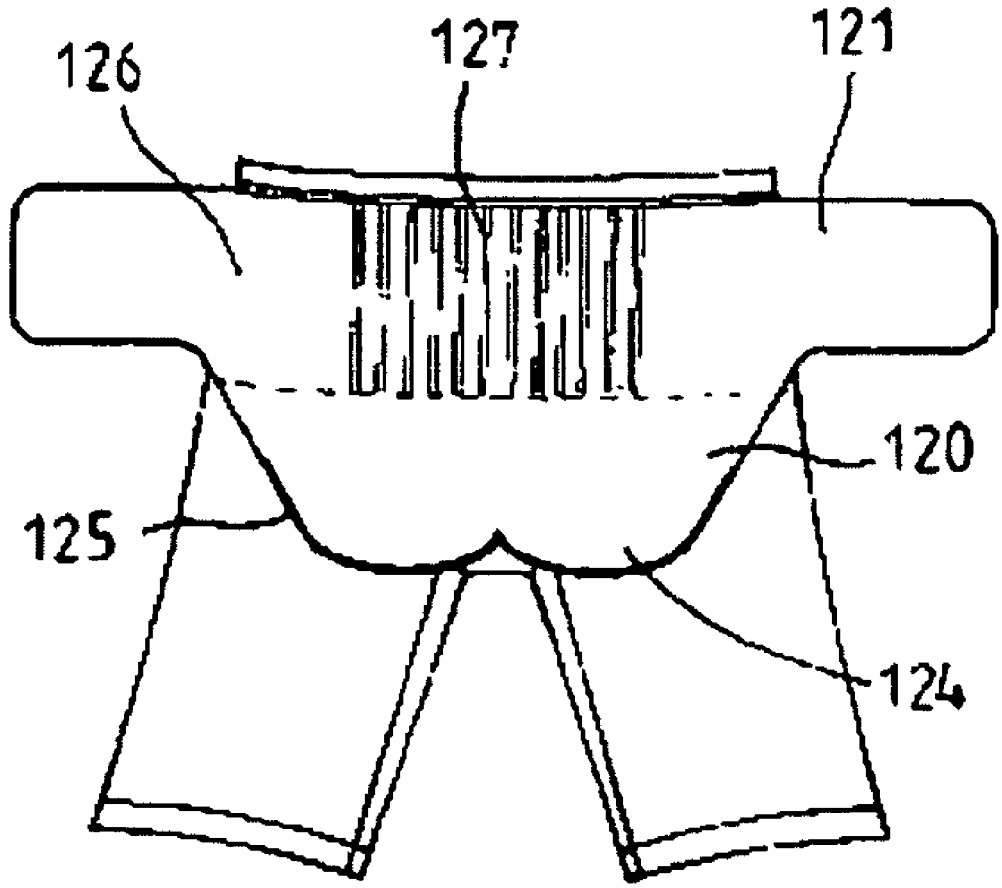
FIG. 4 is a schematic rear view of a body of functional clothes as shown in FIG. 1, in which a hip support plate is coupled to a rear portion of the body.

FIGS. 3A, 3B and 4 show an abdominal support plate and a hip support plate coupled to the body 100 of the functional clothes.

As shown in FIGS. 3A, 3B and 4, the abdominal support plate 110 is coupled to a front portion of the body 100 corresponding to an abdominal region of a user. The abdominal support plate 110 is relatively inflexible; namely, the abdominal support plate 110 may include a more inelastic material such as Spandex Loop and Lycra Loop.

The present invention does not limit the shapes of the abdominal support plate 110, but the abdominal support plate 110 may have a size sufficient for surrounding the abdominal region of the user.

In addition, the abdominal support plate 110 may be fabricated by using a wool fiber such that a Velcro tape 122 of the hip support plate 120 (see FIG. 4) may be attached to any portions of the abdominal support plate 110.

The abdominal support plate 110 is provided at a central portion thereof with a lower abdominal support section 111, which is rounded so as to effectively support a lower abdominal region of the user.

In cases of functional male clothes, the abdominal support plate 110 supports an upper abdominal region of the user and a cavity section 103 (see FIG. 3B) is formed at a lower portion of the abdominal support plate 110 in order to receive the genitals of the user.

In addition, an edge of the abdominal support plate 110 is fixed to the body 100 by means of a first sewing section 112 and an inner potion of the abdominal support plate 110 is fixed to the body 100 by means of a second sewing section 113.

The second sewing section 113 may have a double structure so as to elastically support the lower abdominal region of the user.

As shown in FIG. 4, the hip support plate 120 is coupled to a rear portion of the body 100. The hip support plate 120 has a butterfly shape and is formed at both sides thereof with an extension part 121 having a width corresponding to a width of the waist of the user.

An extension part 121 is provided at an end thereof with a Velcro tape 122.

In addition, a plurality of rubber bands 123 (see FIG. 3B) are provided in an upper inner portion of the hip support plate 120. The rubber bands 123 are transversely aligned between extension parts 121. In general, the hip support plate 120 is made from a more flexible material than the abdominal support plate 110 such as CoolMax and Moistex.

A waist support section 127 (see FIG. 4) is formed at an upper portion of the hip support plate 120 by densely sewing predetermined portions of the hip support plate 120 corresponding to a lumbar vertebra region and a sacral region of the user.

Therefore, when the user wears the functional clothes of this embodiment, the functional clothes can securely support the lumbar vertebra region and the sacral region of the user, thereby protecting the waist of the user.

A lower portion 124 of the hip support plate 120 is sewed together with the body 100 along a lower part of the hip region of the user. A third sewing section 125 is formed at an outer part of the lower portion 124 of the hip support plate 120 corresponding to ⅔ height of the lower portion 124 of the hip support plate 120. An upper end of the hip support plate 120 may be aligned lower than an upper end of the body 100.

Accordingly, when the user wears the functional clothes of this embodiment, the hip support plate 120 is pulled up so that the upper end of the hip support plate 120 matches with the upper end of the body 100, and the lower portion 124 of the hip support plate 120 surrounds the gluteus maximus muscle, thereby supporting and protecting the gluteus maximus muscle.

Figure 5:
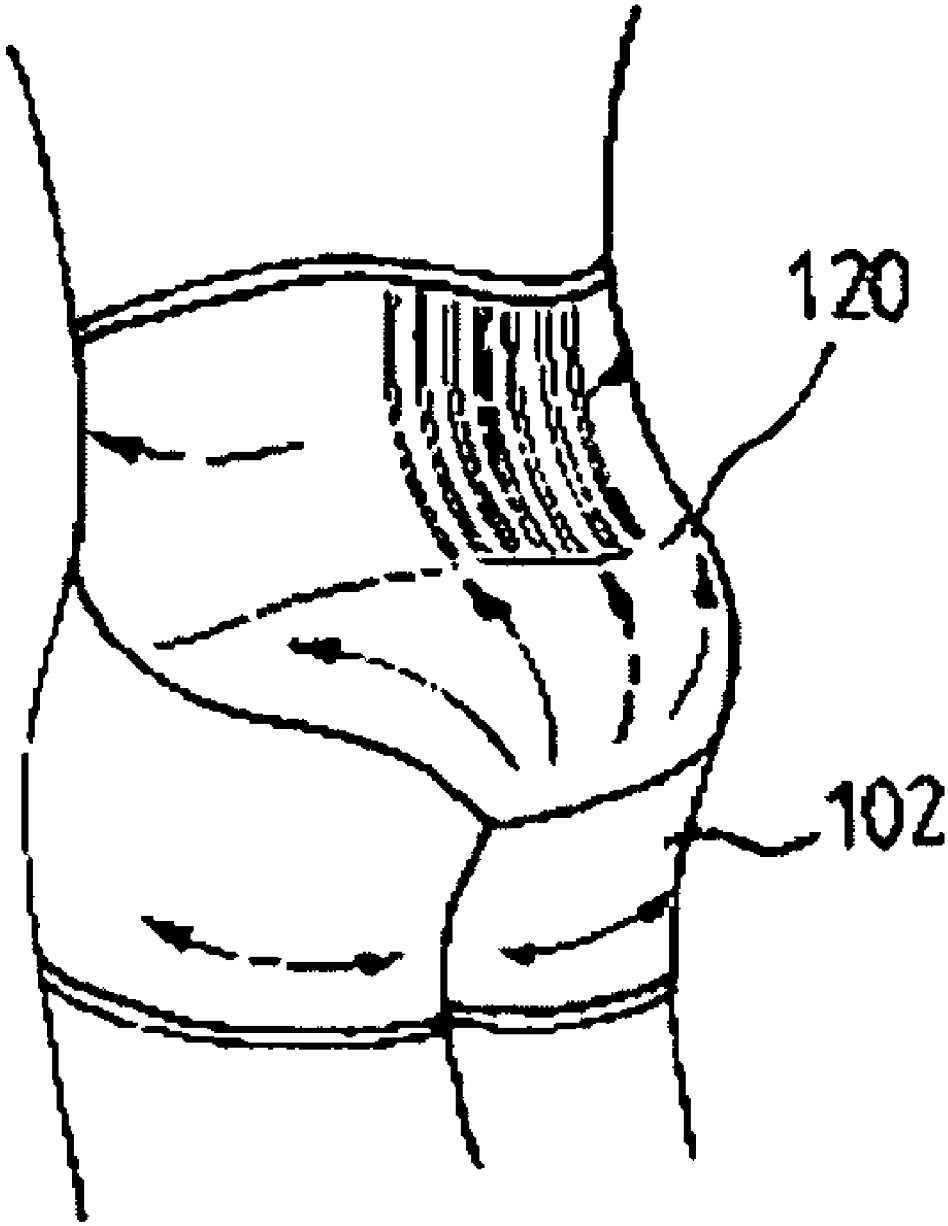
FIG. 5 is a rear-side view illustrating a user wearing functional clothes according to one embodiment of the present invention.
Figure 6A:
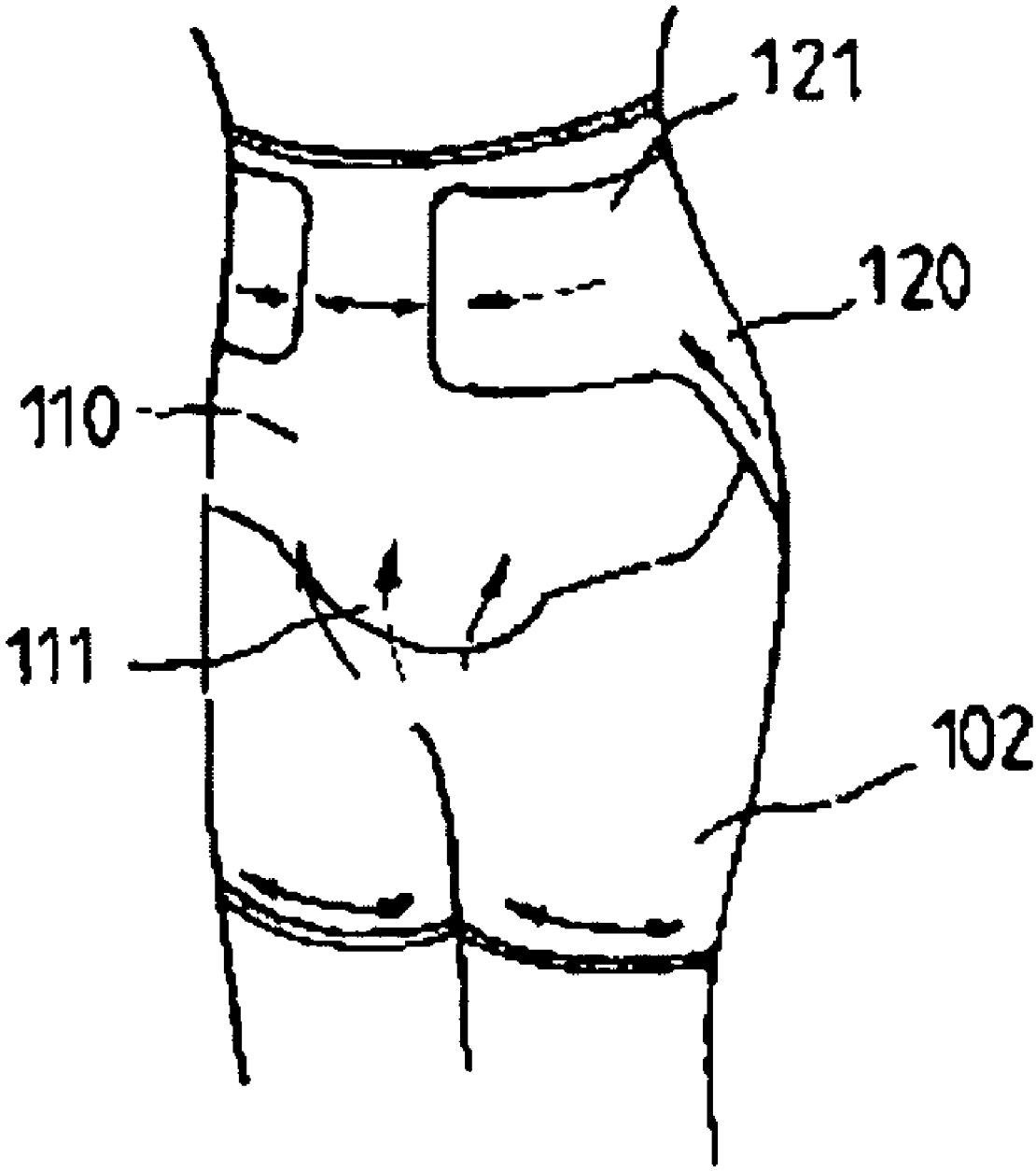
FIG. 6A is a front-side view illustrating a user wearing functional female clothes according to one embodiment of the present invention.
Figure 6B:
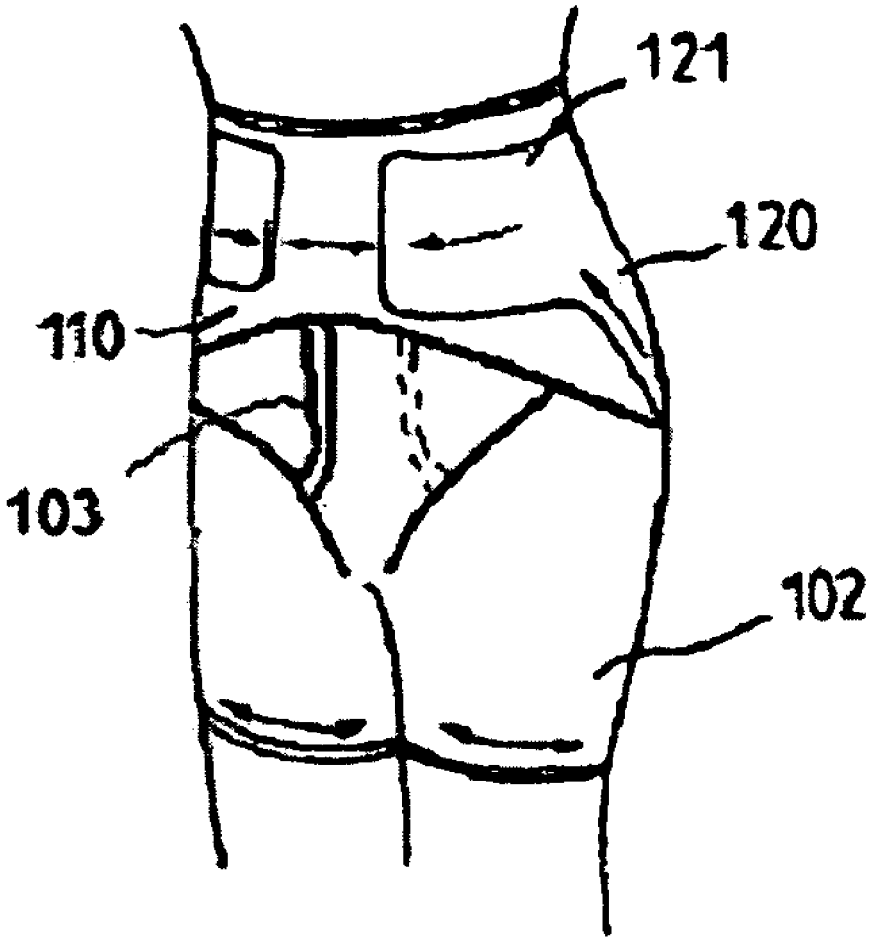
FIG. 6B is a front-side view illustrating a user wearing functional male clothes according to one embodiment of the present invention.
Figure 7:
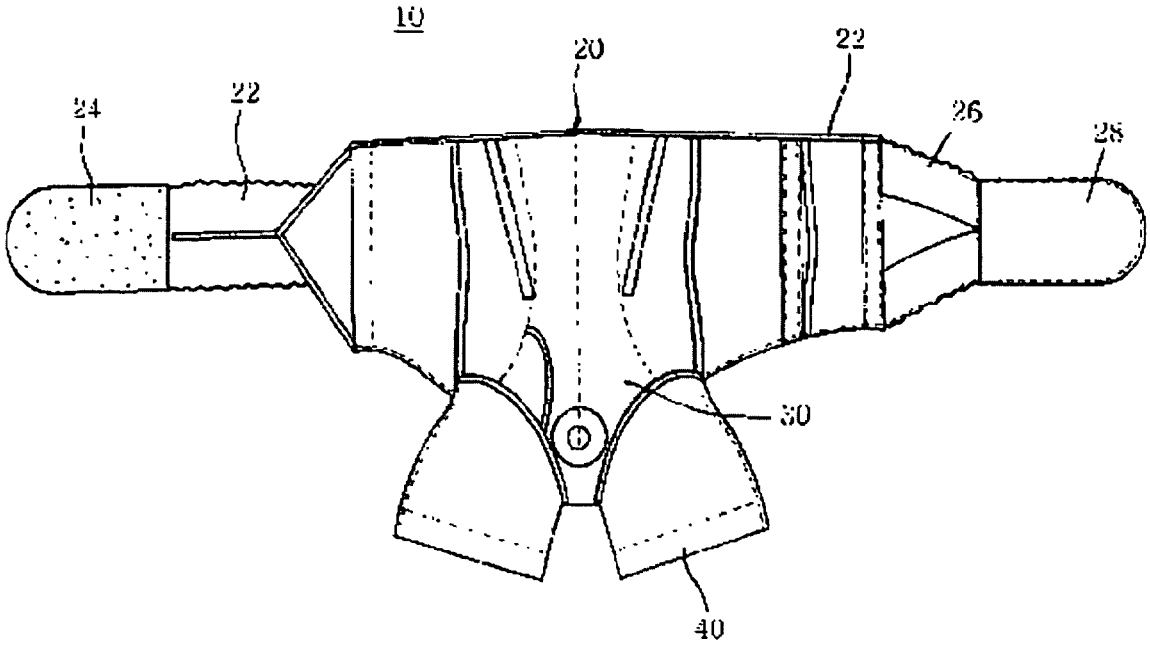
FIG. 7 is a front view of a conventional male girdle having an abdominal band.

FIGS. 5, 6A and 6B show the user wearing the functional clothes according to an embodiment of the present invention. Arrows shown in FIGS. 5, 6A and 6B represent force direction applied to the user by means of the functional clothes.

As shown in FIGS. 5, 6A and 6B, force is applied in the upward direction of the gluteus maximus muscle by means of the hip support plate 120. In addition, the extension parts 121 apply force around the waist of the user, and the thigh sections 102 apply force around the thighs of the user.

In addition, the extension parts 121 are attached to the abdominal support plate 110 so that the abdominal support plate 110 applies force around the abdominal region of the user while being pulled outwardly of the waist of the user. In addition, the lower abdominal support section 111 applies force in the upward direction of the lower abdominal region.

Accordingly, the functional clothes can support and protect the gluteus muscle, the erector spinae muscle, the biceps femoris muscle, the rectus abdominis muscle, the obliquus extemus abdominis muscle, the pectineus muscle, the femoral muscle, the tensor fasciae latae muscle, the quadriceps muscle, and the rectus femoris muscle.

In addition, since the extension parts 121 are attached to the abdominal support plate 110 from both sides of the abdominal support plate 110 without being overlapped with each other, the abdominal region of the user cannot be tightly pressed.

As described above, the functional clothes may be provided at front and rear portions thereof with the abdominal support plate and the hip support plate, so that the functional clothes can support and protect the waist, the abdominal region and the hip of the user when the user wears the functional clothes.

In addition, the abdominal support plate is provided at the lower portion thereof with the lower abdominal support section, so the functional clothes of the present invention can support and protect the pelvis section of the user.

Furthermore, the functional clothes may have the hip support plate provided with the waist support section, so that the functional clothes can support and protect the waist of the user when the user wears the functional clothes. The waist support section is formed by densely sewing predetermined portions of the hip support plate along a waistline of the user without inserting a solid member into the hip support plate, so the functional clothes have an improved external appearance while representing superior wearing sensation. In addition, the user wearing the functional clothes can freely move.

In addition, since only a part of the hip support plate is coupled to the body of the functional clothes along a lower portion of the hip, the function clothes can elastically support the hip of the user if the user pulls up the hip support plate.

Furthermore, the upper portion and the extension part of the hip support plate may be made from elastic materials, and a fastening unit may be provided to allow an extension part of the hip support plate to be attached to a portion of the abdominal support plate. Therefore, differently from the conventional abdominal band, the functional clothes of this embodiment do not tightly press the abdominal region of the user. In addition, the user can adjust pressing force of the functional clothes with respect to the abdominal region of the user.

In addition, the functional clothes may be made from an elastic fiber having a superior sweat absorption property, so the functional clothes can be effectively used as sportswear.

Furthermore, the functional clothes may simultaneously support the waist, the hip and the abdominal region of the user, so the functional clothes can be used for correcting the bodyline of the user.

In addition, the functional clothes may be fabricated while taking the distinction of sex into consideration. In cases of functional male clothes, the cavity section is formed at the lower portion of the functional male clothes in order to receive the genitals of the user.

Although example embodiments of the present invention has been described for illustrative purposes, those skilled in the art will appreciate that various modifications, additions and substitutions are possible, without departing from the scope and spirit of the invention.

What is claimed is:

1. A functional clothing article comprising:

a body for receiving and supporting a femoral region, a hip region, an abdominal region and a waist region of a user, the body including two leg portions for receiving respective legs of the user;

an abdominal support unit provided at a front portion of the body to support the abdominal region of the user;

a hip support unit provided at a rear portion of the body to support the hip region, the hip support unit including a fastening unit for detachably coupling the hip support unit to the abdominal support unit, wherein the hip support unit includes an upper portion and extension parts extending out from the hip support unit, the extension parts serving as the fastening unit, the upper portion and the extension parts include elastic materials to allow the user to adjust pressing force with respect to the abdominal region of the user, a plurality of rubber bands are transversely provided from an inner portion of the hip support unit to an inner portion of the extension part, and the extension part is attachable to a portion of the abdominal support unit.

2. The functional clothing article as claimed in claim 1, wherein the hip support unit is made from more flexible material than the abdominal support unit.

3. The functional clothing article as claimed in claim 1, wherein the abdominal support unit has a rounded lower portion to support a lower portion of the user's abdominal region.

4. The functional clothing article as claimed in claim 1, wherein the abdominal support unit supports an upper portion of the abdominal region, and a lower portion of the abdominal support unit has a cavity section for receiving genitals of the user.

5. The functional clothing article as claimed in claim 2, wherein the hip support unit includes an elastic material.

6. The functional clothes as claimed in claim 1, wherein the hip support unit has a butterfly shape and a part of the hip support unit is coupled to the body along a lower portion corresponding to the hip region of the user.

7. The functional clothes as claimed in claim 6, wherein the hip support unit has a waist support section, which is positioned corresponding to the waist region of the user, for elastically supporting the waist region of the user in a longitudinal direction of the waist region.

8. The functional clothes as claimed in claim 1, wherein the body, the abdominal support unit and the hip support unit are made from elastic fibers having a sweat absorption property.

9. A functional clothing article comprising:

a body for receiving and supporting a femoral region, a hip region, an abdominal region and a waist region of a user, the body including two leg portions for receiving respective legs of the user;

an abdominal support unit provided at a front portion of the body, supporting an upper portion of the abdominal region, and having a cavity section for receiving genitals of the user;

a hip support unit provided at a rear portion of the body to support the hip region, the hip support unit including a fastening unit for detachably coupling the hip support unit to the abdominal support unit, wherein the hip support unit includes an upper portion and extension parts extending out from the hip support unit, the extension parts serving as the fastening unit, the upper portion and the extension parts include elastic materials to allow the user to adjust pressing force with respect to the abdominal region of the user, a plurality of rubber bands are transversely provided from an inner portion of the hip support unit to an inner portion of the extension part, and the extension part is attachable to a portion of the abdominal support unit.

10. The functional clothing article of claim 1, wherein the body is in the form of breeches.

11. A functional clothing article comprising:

a body for receiving and supporting a femoral region, a hip region, an abdominal region and a waist region of a user;

an abdominal support unit provided at a front portion of the body to support the abdominal region of the user;

a hip support unit provided at a rear portion of the body to support the hip region, the hip support unit including a fastening unit for detachably coupling the hip support unit to the abdominal support unit; wherein the hip support unit includes an upper portion and extension parts extending out from the hip support unit, the extension parts serving as the fastening unit, the upper portion and the extension parts include elastic materials to allow the user to adjust pressing force with respect to the abdominal region of the user, a plurality of rubber bands are transversely provided from an inner portion of the hip support unit to an inner portion of the extension part, and the extension part is attachable to a portion of the abdominal support unit.

* * * * *